US005430242A

United States Patent [19]

Morita

[11] Patent Number: 5,430,242

[45] Date of Patent: Jul. 4, 1995

[54] ELECTRONIC MUSICAL INSTRUMENT

[75] Inventor: Shigehiro Morita, Hamamatsu, Japan

[73] Assignee: Kabushiki Kaisha Kawai Gakki Seisakusho, Japan

[21] Appl. No.: 205,739

[22] Filed: Mar. 4, 1994

[51] Int. Cl.[6] ..... G10H 1/36; G10H 1/38

[52] U.S. Cl. ..... 84/609; 84/613; 84/DIG. 22

[58] Field of Search ..... 84/609–614, 84/634–638, DIG. 12, DIG. 22

[56] References Cited

U.S. PATENT DOCUMENTS 4,960,030 10/1990 Fujimori ..... 84/609

*Primary Examiner*—Stanley J. Witkowski

[57] ABSTRACT

Disclosed is an electronic musical instrument for generating musical tones based on part data and automatic performance data to thereby execute an automatic performance, comprising first memory means in which part data and automatic performance data corresponding to demonstration music pieces have been stored; a play buffer for storing the part data currently in use; second memory means for temporarily saving the contents of the play buffer; start instructing means for instructing a start of a performance of a demonstration music piece; first processing means for saving the currently used part data, stored in the play buffer, into the second memory means, and for reading out the part data corresponding to a demonstration music piece from the first memory means and for setting the read-out part data in the play buffer, when instructed by the start instructing means; automatic performance means for executing an automatic performance based on the part data, set in the play buffer by the first processing means, and the automatic performance data stored in the first memory means; and second processing means for restoring the part data, saved in the second memory means by the first processing means, into the play buffer when the automatic performance means stops executing an automatic performance.

8 Claims, 5 Drawing Sheets

STRUCTURE OF DEMONSTRATION PERFORMANCE DATA

ELECTRONIC MUSICAL INSTRUMENT

BACKGROUND OF THE INVENTION AND RELATED ART

The present invention relates to an electronic musical instrument having with a demonstration performance function.

Recent electronic musical instruments, such as an electronic piano, an electronic organ and a synthesizer, have an automatic performance function. The use of this automatic performance function permits a player to enjoy playing an instrument by playing a specific part while automatically playing several parts. For instance, while generating musical tones of accompaniment parts, such as a drum part, a base part and a chord part, by using the automatic performance function, the player can play a melody part with the timbre of a trumpet.

This automatic performance function is accomplished by a central processing unit (hereinafter referred to as "CPU") incorporated in the electronic musical instrument. When an instruction is given to start the automatic performance, first, the CPU sequentially reads out automatic performance data stored part by part in a memory of a sequencer externally connected to the electronic musical instrument, or in a memory of the electronic musical instrument, and sequentially sends the automatic performance data to individual tone generators associated with the respective parts. Each tone generator generates tone signals of each part based on the received automatic performance data. The tone signals for a plurality of the parts, generated from the individual tone generators, are sent to a loudspeaker to be converted into acoustic signals. Accordingly, the simultaneous performance of a plurality of the parts or an automatic performance is executed.

Since the automatic performance function in a conventional electronic musical instrument is accomplished in the above manner, the same number of the tone generators as the number of the parts is required. The provision of the tone generators equal in number to the parts increases the cost, making it difficult to apply the above structure to other electronic musical instruments than an expensive one. Therefore, recently has been developed a multi-tone generator which will simultaneously generate the musical tones of a plurality of the parts and has become popular.

One of those multi-tone generators, called a multi-timbre tone generator, can efficiently perform the automatic performance, so that active studies and development are made on this tone generator. The multi-timbre tone generator can generate a plurality of timbres at a time, and can arbitrarily select an oscillator that is assigned to the tone generation of each part. In other words, in the multi-timbre tone generator, each oscillator is not assigned previously to each of the parts, the number of the oscillator to be assigned to each part is determined and also it is determined what numbered oscillator is assigned, when tone generation is requested.

In the multi-timbre tone generator, part data including, for example, a program number, volume data and pan-pot data, is stored part by part in a memory area called a "play buffer" before executing the automatic performance of a plurality of the parts. Each oscillator refers to the contents of this play buffer to generate a musical tone that has the timbre, volume, pan-pot, in accordance with the part data.

This play buffer is generally provided in a random access memory (RAM) incorporated in the electronic musical instrument. At the time of power on, the initial values of the part data, which are stored in, for example, a read only memory (ROM), are loaded into the play buffer to determine the initial timbre, volume and pan-pot. Therefore, the initial timbre and so on at the time of conducting the automatic performance are determined by the part data which has been written in the ROM as factory default setting.

Electronic musical instruments having the automatic performance function can carry out a demonstration performance of a predetermined music by using the automatic performance function to generate the musical tones of all the parts (e.g., four parts: drum, bass, chord and melody). That is, a demonstration performance can be said to be a special case of the automatic performance.

The demonstration performance starts in response to an instruction from a control panel or the like. When the demonstration performance starts, the CPU sequentially reads out the automatic performance data for a demonstration music, stored part by part in a memory of a sequencer externally connected to the electronic musical instrument, or in a memory of the electronic musical instrument, and sequentially sends the automatic performance data to individual tone generators associated with the respective parts. Each tone generator generates tone signals of each part based on the received automatic performance data. The tone signals for a plurality of the parts, generated from the individual tone generators, are sent to a loudspeaker to be converted into acoustic signals. Consequently, the demonstration performance is executed through the simultaneous performance of a plurality of the parts. In case of a demonstration performance, the timbre, volume, pan-pot and the like of the demonstration music are also determined by the part data that has been loaded in the play buffer at that time.

Generally, the contents of the play buffer can be altered as needed using the control panel so that the musical tones desired by the user can be generated. This play buffer is initialized at the time of power on. In this initialization, the initial values of the part data previous stored in the ROM are set in the play buffer. Immediately after power on, therefore, the timbre, volume, pan-pot and the like of each part are also determined specifically. To play a specific part with the timbre, volume, pan-pot and the like, the user should alter the contents of the play buffer himself or herself using the control panel.

The alternation of the content of the play buffer should be carried out in the demonstration performance. To execute the demonstration performance immediately after power on, the initial values of the part data loaded in the play buffer should match with the part data used by the individual parts of the demonstration music. If there is no match, the user should use the control panel to alter the contents of the play buffer. To ensure the demonstration performance without altering the contents of the play buffer immediately after power on, therefore, the demonstration music, which is to be played in the electronic musical instrument, must be selected from those pieces of music which are suitable for the initial values of the part data, thus limiting the types of the music pieces that can be used as demonstration music pieces.

In case where the user sets desired part data in the play buffer to interrupt the performance in progress and instructs a demonstration performance, the part data set in the play buffer may not match with the part data the demonstration music needs, disabling the proper demonstration performance. Before starting the demonstration performance, therefore, the user sets part data necessary for the demonstration music in the play buffer, and then starts the demonstration performance. In this case, however, the original contents of the play buffer are destroyed, so that it undesirably takes time to restore the original contents or to return the state in which the instrument had been before the demonstration performance started, after the demonstration performance is completed.

OBJECT AND SUMMARY OF THE INVENTION

It is therefore an object of the present invention to provide an electronic musical instrument with an excellent operability, in which various pieces of music are used as demonstration music, a proper demonstration performance is started regardless of the state of the electronic music instrument, and the state of the electronic music instrument is able to be returned to the state in which the instrument had been before the demonstration performance, when the demonstration performance is completed.

To achieve the above object, according to the present invention, there is provided an electronic musical instrument for generating musical tones based on part data and automatic performance data to thereby execute an automatic performance, comprising first memory means in which part data and automatic performance data corresponding to demonstration music pieces have been stored; a play buffer for storing the part data currently in use; second memory means for temporarily saving the contents of the play buffer; start instructing means for instructing a start of a performance of a demonstration music piece; first processing means for saving the currently used part data, stored in the play buffer, into the second memory means, and for reading out the part data corresponding to a demonstration music piece from the first memory means and for setting the read-out part data in the play buffer, when instructed by the start instructing means; automatic performance means for executing an automatic performance based on the part data, set in the play buffer by the first processing means, and the automatic performance data stored in the first memory means; and second processing means for restoring the part data, saved in the second memory means by the first processing means, into the play buffer when the automatic performance means stops executing an automatic performance. The aforementioned case where the automatic performance means stops executing an automatic performance is, for example, when the end of a demonstration music piece is detected, or when an instruction is given from stop instructing means (to be described later) during the demonstration performance.

According to the electronic musical instrument of the present invention for generating musical tones based on the part data and the automatic performance data to thereby execute an automatic performance, the part data and the automatic performance data corresponding to demonstration music pieces are stored in the first memory means. When an instruction is given to start the automatic performance of a demonstration music piece, the part data currently in use and stored in the play buffer is saved in the second memory means, and the part data corresponding to the demonstration music piece is read out from the first memory means and is set in the play buffer. The automatic performance of the demonstration music piece is executed based on the part data, set in the play buffer, and the automatic performance data stored in association with this demonstration music piece in the first memory means. When the end of the demonstration music piece is detected, or when the performance of the demonstration music piece is stopped by an instruction given from the stop instructing means during demonstration performance, the part data, saved previously in the second memory means, is restored in the play buffer. That is, the contents of the play buffer is set back to the contents of the play buffer just before the demonstration performance started.

Since the part data and the automatic performance data corresponding to each demonstration music piece have been stored as a pair in the first memory means, and when an instruction is given to start a demonstration performance, the demonstration performance is carried out based on the part data and the automatic performance data associated with that demonstration music piece, the part data will always match with the automatic performance data. The present invention therefore comes free of the restriction of the prior art that a demonstration music piece matching with the initial values of the part data should be selected, thus allowing every piece of music to be used as a demonstration music piece.

In starting a demonstration performance, the part data, stored presently in the play buffer, is saved in the second memory means, and then new part data corresponding to the demonstration music piece is set in the play buffer, and thereafter, the demonstration performance is started. Regardless of what has been set in the play buffer, therefore, the proper demonstration performance will be started. When the demonstration performance is stopped, the part data, saved previously in the second memory means, is restored in the play buffer, so that when the demonstration performance is stopped, it is possible to return the state in which the electronic musical instrument had been before starting the demonstration performance. This electronic musical instrument therefore requires no manual operation to rewrite data in the play buffer in order to start a demonstration performance or to return the state in which the instrument had been before the demonstration performance started, and is thus excellent in operability.

According to a first preferred embodiment of the present invention, when the end of a demonstration music piece is detected, the second processing means restores the part data, saved in the second memory means by the first processing means, into the play buffer. When the end of a demonstration music piece is detected, therefore, the part data in the play buffer is automatically restored to what had been before the demonstration performance started, eliminating the need for a separate restoring operation. This electronic musical instrument is thus excellent in operability.

According to a second preferred embodiment of the present invention, stop instructing means may be provided for giving an instruction to stop playing a demonstration music piece in automatic performance, and wherein the second processing means restores the part data, saved in the second memory means by the first processing means, into the play buffer in accordance with the instruction from the stop instructing means. When the performance of a demonstration music piece is stopped by the stop instructing means, therefore, the part data in the play buffer is automatically restored to what had been before the demonstration performance started, eliminating the need for a separate restoring operation. This electronic musical instrument is thus excellent in operability.

According to a third preferred embodiment of the present invention, the stop instructing means may be constituted of the same switch as the start instructing means. This operator may be designed in such a way that a single operator is used as the start instructing means when there is an ON event and as the stop instructing means when there is an OFF event. This design allows the start instructing means and the stop instructing means to be constituted by a smaller number of operators.

According to a fourth preferred embodiment of the present invention, the first processing means may be a CPU. Further, according to a fifth preferred embodiment of the present invention, the second processing means may be a CPU. The use of a CPU can reduce the amount of hardware.

According to a sixth preferred embodiment of the present invention, the automatic performance means comprises a CPU and a tone generator.

According to a seventh preferred embodiment of the present invention, the play buffer is a RAM.

DESCRIPTION OF THE PREFERRED EMBODIMENT

An electronic musical instrument according to one embodiment of the present invention will be described in detail below with reference to the accompanying drawings. The following description is centered on the structure and operation which accomplish the function to start and stop a demonstration performance.

Figure 1:
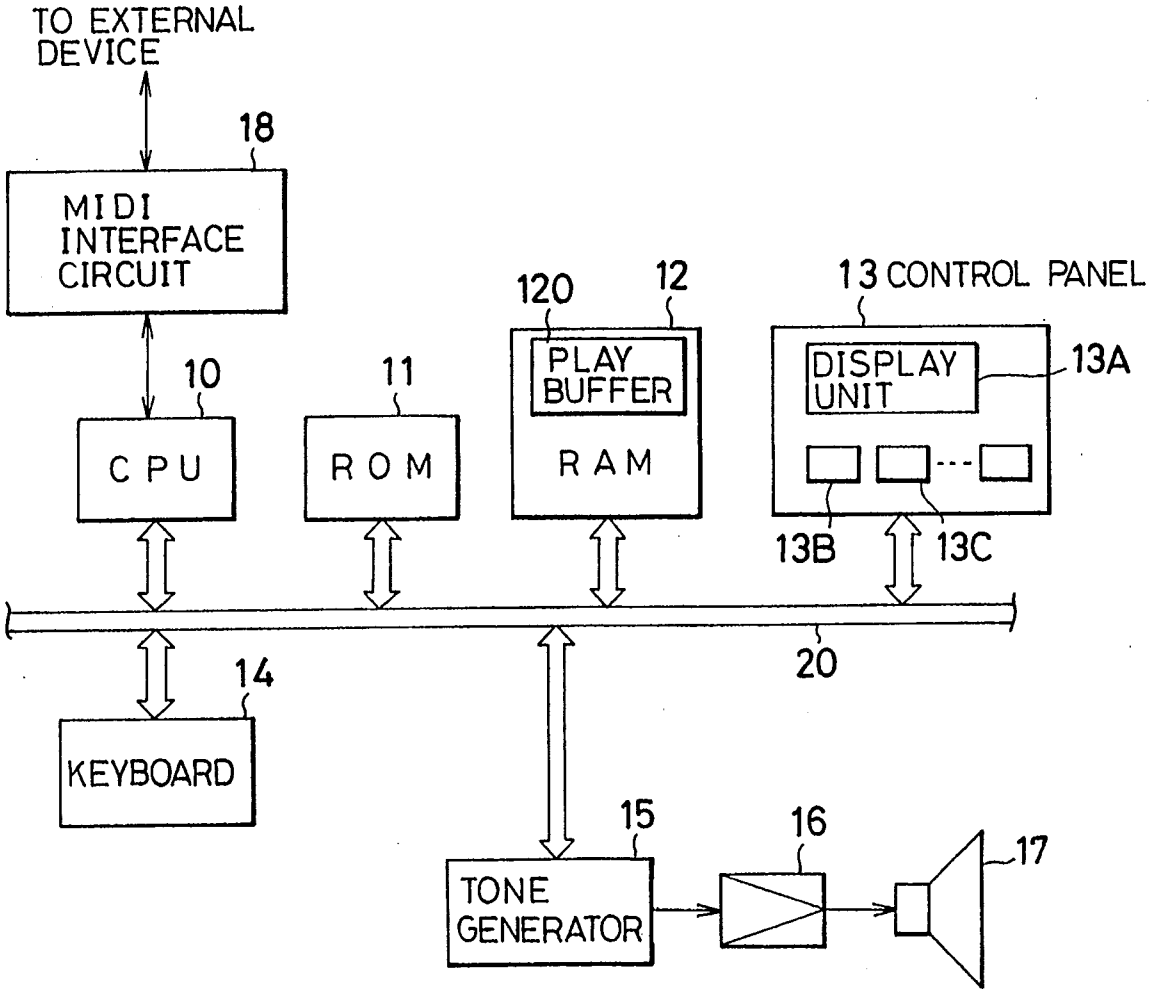
FIG. 1 is a block diagram illustrating a schematic structure of an electronic musical instrument according to one embodiment of the present invention.

FIG. 1 presents a block diagram showing the schematic structure of an electronic musical instrument according to the embodiment of the present invention. This electronic musical instrument comprises a CPU 10, a ROM 11, a RAM 12, a control panel 13, a keyboard 14 and a tone generator 15, which are mutually connected by a system bus 20.

The CPU 10 performs the general control of the electronic musical instrument in accordance with a control program stored in the ROM 11. For example, a tone-ON process performs in response to the depression of a key on the keyboard 14, and the processes perform for an automatic performance and a demonstration performance in response to the depression of specific keys on the control panel 13. The first processing means and second processing means of the present invention are accomplished by the function of the CPU 10. A part of the automatic performance means is also accomplished by the function of the CPU 10. The other part of the automatic performance means is accomplished by the tone generator 15 which will be described later.

A MIDI interface circuit 18 is connected via a special line to the CPU 10. The MIDI interface circuit 18 is used to control the exchange of MIDI data between the electronic musical instrument and an external device. Such external devices include a personal computer, a sequencer and other electronic musical instruments, which are designed to process MIDI data.

Figure 5:
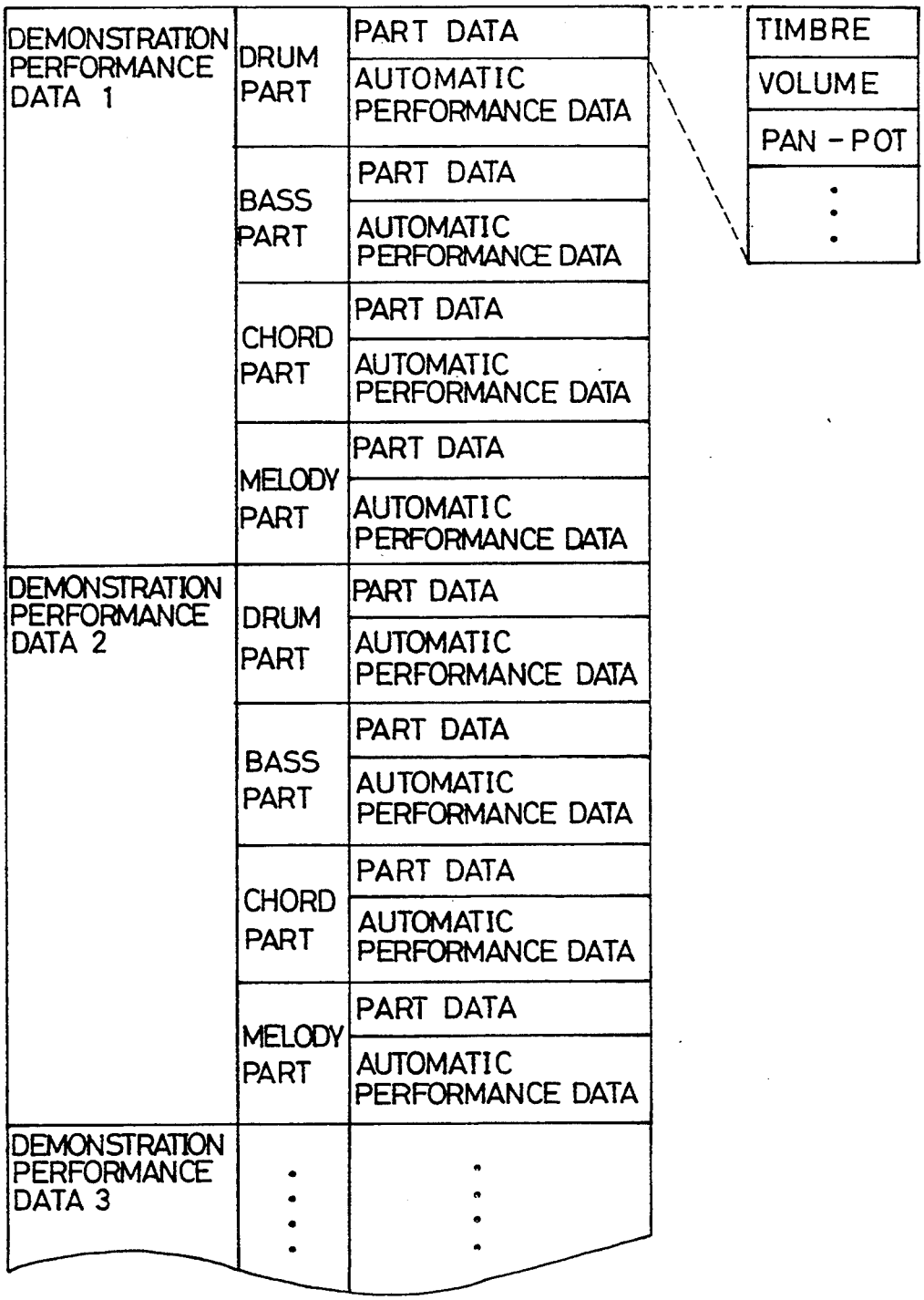
FIG. 5 shows an example of the format of demonstration performance data that is used in the embodiment.

The demonstration performance data has a structure as shown in FIG. 5, for example. Demonstration performance data corresponding to one piece of demonstration music consists of, for example, four parts, drum, bass, chord and melody. Each of four parts consists of the part data and the automatic performance data. The part data includes data on the timbre of each of four parts (e.g., the timbre of an acoustic drum for the drum part, the timbre of a wood bass for the bass part, the timbre of a piano for the chord part, and the timbre of a trumpet for the melody part), volume data of each of four parts, and pan-pot data of each of four parts. The automatic performance data is data about rhythms and intervals which individual parts (drum, bass, chord and melody) should generate.

Stored in the ROM 11 are the aforementioned control program to operate the CPU 10 and various types of fixed data the CPU 10 uses in various processes. A part of the ROM 11 (demonstration performance data area) is used as the first memory means of the present invention. Plural pieces of demonstration performance data corresponding to plural pieces of demonstration music have been stored in the demonstration performance data area.

The contents of the ROM 11 are read out by the CPU 10 via the system bus 20. More specifically, the CPU 10 reads out the control program (instructions) from the ROM 11 via the system bus 20, decodes and executes the control program, and reads out the predetermined fixed data for various processes. Also, the CPU 10 reads out the demonstration performance data from the ROM 11 via the system bus 20, converts the data into tone data (which consists of, for example, waveform address, frequency data, envelope data and filter coefficient) which the tone generator 15 can interpret, and sends the tone data via the system bus 20 to the tone generator 15.

The RAM 12 temporarily stores various types of data that are used to execute the control program, and has various areas, such as a data buffer, register and flag, defined therein. The CPU 10 access the RAM 12 via the system bus 20. The "play buffer" in the present invention is realized by a play buffer 120 defined in the RAM 12. The play buffer 120 is separated into blocks corresponding to tone-ON channels (e.g., 16 channels) of the electronic musical instrument. Stored in each block of the play buffer 120 is the part data currently in use. The play buffer 120 may be provided in a register (not shown) which is incorporated in the CPU 10.

The control panel 13 is used to allow a user to instruct the electronic musical instrument about various operations. The control panel 13 is provided with a display unit 13A and various switches, such as a demonstration performance switch 13B and value setting switches 13C.

The display unit 13A is used to display the status of the electronic musical instrument and various messages. This display unit 13A may be constituted of a character display unit comprising an LCD, or an LED display unit consisting of 7-segment LEDs. The numeral, character, symbol, etc., which are displayed on the display unit 13A, correspond to the data sent via the system bus 20 from the CPU 10.

The demonstration performance switch 13B is used to instruct the start or termination of a demonstration performance. The start instructing means and stop instructing means in the present invention are accomplished by this demonstration performance switch 13B. The value setting switches 13C are used to select a demonstration music piece and rewrite the contents of the play buffer 120. The display unit 13A displays predetermined data in association with the operation of the value setting switches 13C. Although the control panel 13 is provided with a timbre select switch, volume switch, effect designate switch (none shown), etc. in addition to the aforementioned switches, those switches are not directly concerned with the present invention and their description will not be given.

The control panel 13 is connected to the CPU 10 via a panel scan circuit (not shown). The panel scan circuit scans the individual switches on the control panel 13 and forms panel data consisting of a train of bits indicating the ON/OFF status of each switch. This panel data is sent via the system bus 20 to the CPU 10. The panel data is then stored in the RAM 12 under the control of the CPU 10, and is used to determine if a panel event has occurred. (The details will be given later.)

The keyboard 14 comprises a plurality of keys for allowing the user to instruct intervals of musical tones, a plurality of key switches which are opened or closed in interlocking manner with those keys, and a key scan circuit. The key scan circuit scans the individual key switches and forms key data consisting of a train of bits indicating the ON/OFF status of each key. This key data is sent via the system bus 20 to the CPU 10. The key data is then stored in the RAM 12 under the control of the CPU 10, and is used to determine if a keyboard event has occurred. (The details will be given later.)

The tone generator 15 generates a tone signal in accordance with the tone data (which consists of, for example, waveform address, frequency data, envelope data and filter coefficient), sent from the CPU 10. A part of the automatic performance means of the present invention is accomplished by this tone generator 15. Connected to this tone generator 15 is a wave memory (not shown) in which plural pieces of waveform data undergone pulse code modulation (PCM) and corresponding to a plurality of timbres are stored.

The tone generator 15 has a plurality of oscillators which can function simultaneously. The oscillators included in the tone generator 15 are selectively assigned for tone generation by an assigner which is realized by the function of the CPU 10, when, for example, a key on the keyboard 14 is depressed. The oscillator assigned for tone generation reads out the waveform data from the location in the wave memory specified by the waveform address at the speed corresponding to the frequency data, and adds an envelope to the waveform data according to the envelope data to generate a tone signal. The tone signal generated by the tone generator 15 is supplied to an amplifier 16.

The amplifier 16 is of a known type which amplifies the received tone signal by a given amplification factor. The tone signal amplified by the amplifier 16 is sent to a loudspeaker 17 of a know type, which converts the tone signal as an electric signal into an acoustic signal. Through the loudspeaker 17, musical tones associated with the depression/release of the keys on the keyboard 14 or the musical tones associated with an automatic performance are sounded.

Figure 3:
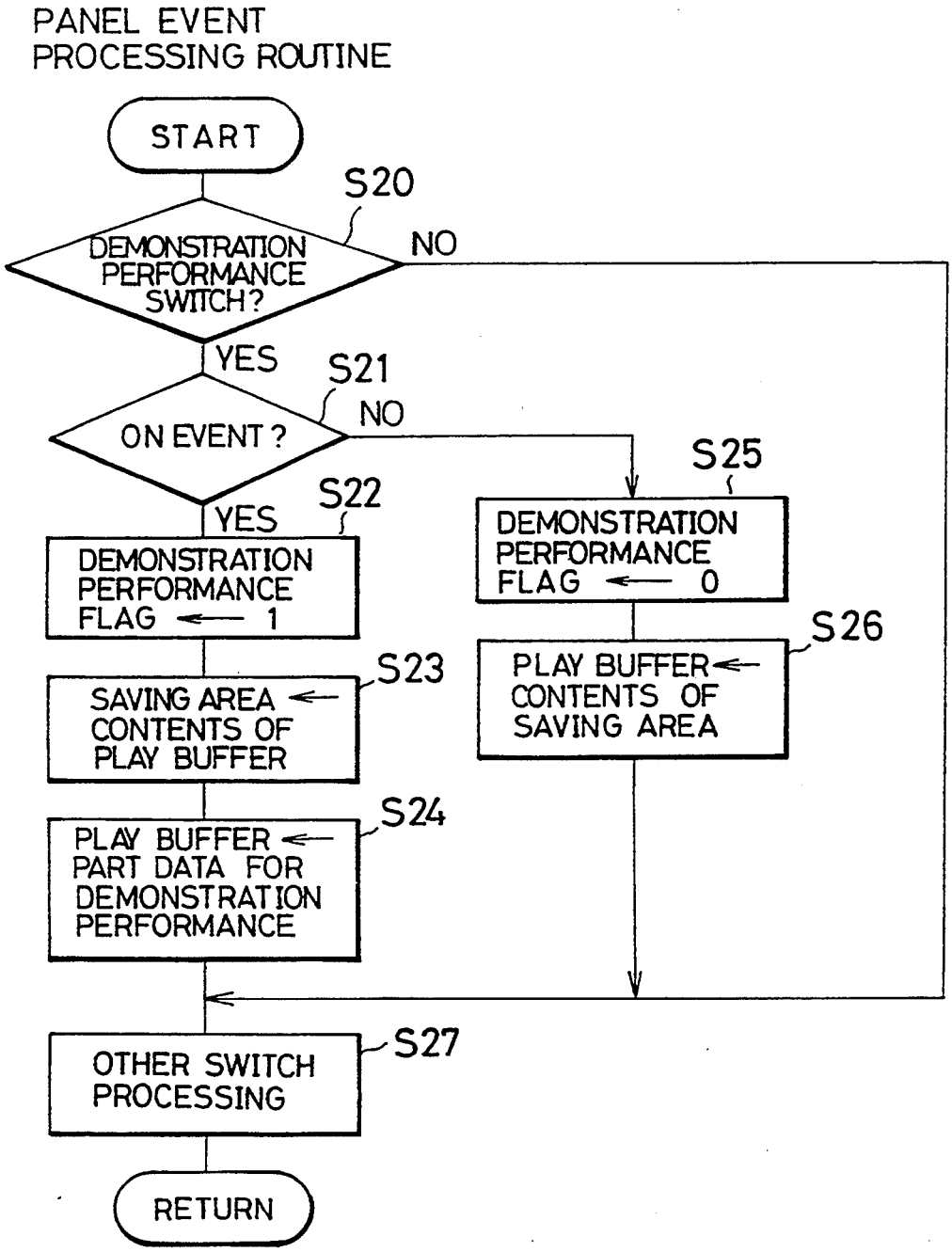
FIG. 3 is a flowchart (panel event processing routine) illustrating the operation of the embodiment.
Figure 4:
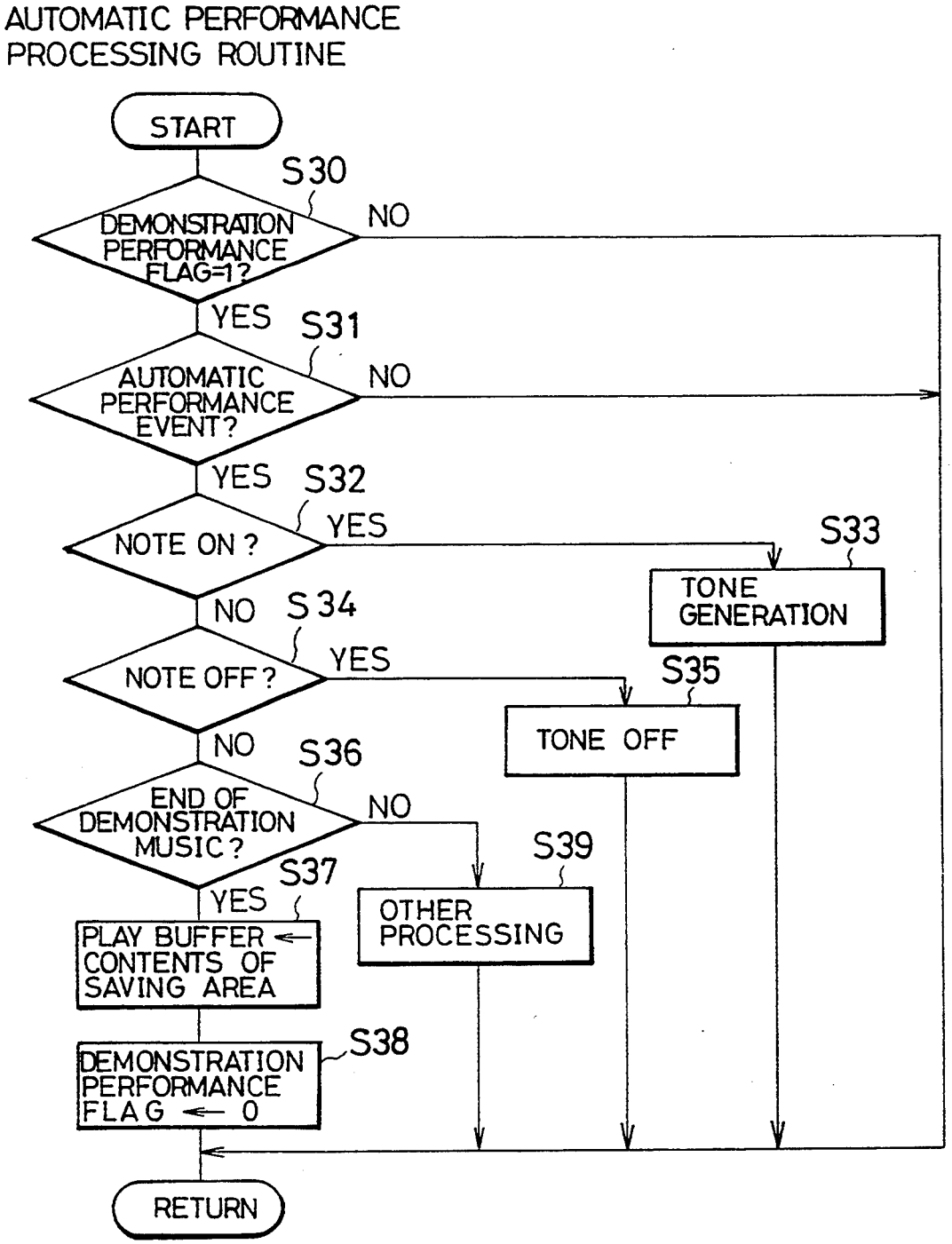
FIG. 4 is a flowchart (automatic performance processing routine) illustrating the operation of the embodiment.

The operation of the electronic musical instrument according to this embodiment with the above-described structure will now be described in detail with reference to the flowcharts given in FIGS. 2 through 4.

Figure 2:
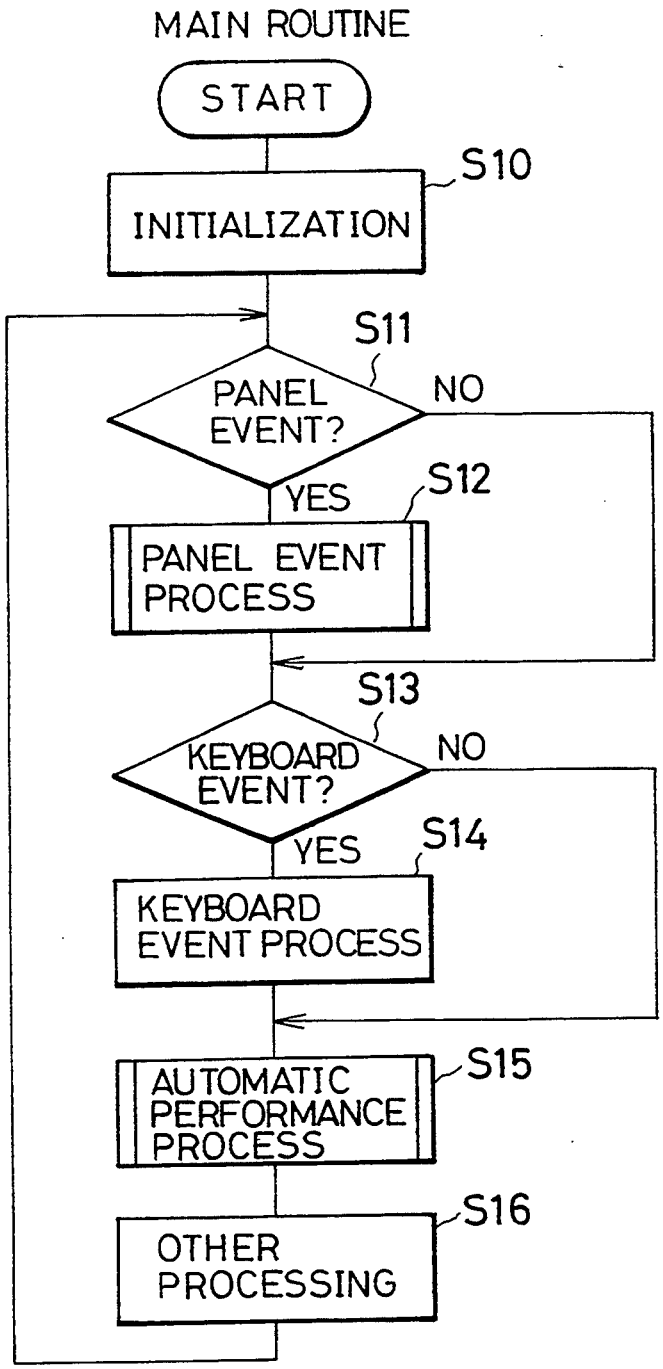
FIG. 2 is a flowchart (main routine) illustrating the operation of the embodiment.

FIG. 2 presents a flowchart showing the main routine of the electronic musical instrument according to this embodiment. This main routine is invoked when the instrument is powered on.

Upon power on, initialization is executed first (step S10). In this initialization, the registers and flags in the CPU 10 are cleared, initial values are set to various types of buffers, registers, flags, etc. defined in the RAM 12, and initial data is set to the tone generator 15 to suppress the generation of undesired tones. In the initialization, the initial values of the part data read out from the ROM 11 are set in the individual blocks in the play buffer 120.

For instance, .individual pieces of the part data are set in such a way that the drum part data is set in the block corresponding to a first tone-ON channel, the piano part data in the block corresponding to a second tone-ON channel, the orchestra part data in the block corresponding to a third tone-ON channel, the trumpet part data in the block corresponding to a fourth tone-ON channel, and so forth. When a tone generation instruction designating a tone-ON channel in the subsequent processing is given, the block in the play buffer 120 corresponding to the designated tone-ON channel is referred to, and the timbre, volume, pan-pot, etc. will be determined according to the part data set in that block.

Next, it is checked if there is any panel event (step S11). This check is executed in the following manner. First, the panel scan circuit of the control panel 13 scans the switches and obtains panel data indicating the ON/-OFF status of each switch (hereinafter called "new panel data").

Then, the new panel data is compared with panel data previously obtained and already stored in the RAM 12 (hereinafter called "old panel data"). If there is an unmatched bit found between the new panel data and the old panel data, a panel event map of a train of bits, each of which corresponding to the unmatched bit is set on, is prepared. When there is an ON-state bit in this panel event map, it is determined that a panel event has occurred.

When it is determined in step S11 that a panel event has occurred, a panel event process is performed (step S12). The details of this panel event process will be given later. When it is determined in step S11 that no panel event has occurred, step S12 is skipped.

Next, it is checked if there is any keyboard event (step S13). This check is executed in the following manner. First, the key scan circuit of the keyboard 14 scans the key switches and obtains key data indicating the ON/-OFF status of each key (hereinafter called "new key data") as a train of bits corresponding to each key.

Then, the new key data is compared with key data previously obtained and already stored in the RAM 12 (hereinafter called "old key data"). If there is an unmatched bit found between the new key data and the old key data, a key event map of a train of bits, each of which corresponding to the unmatched bit is set on, is prepared. When there is an ON-state bit in this key event map, it is determined that a keyboard event has occurred.

When it is determined in step S13 that a keyboard event has occurred, a keyboard event process is performed (step S14). In the keyboard event process, when the occurrent of an ON event of the keyboard is detected, an oscillator in the tone generator 15 is assigned by the assigner to generate the tone signal that is associated with that key depression.

Then, the tone data including the frequency data which is defined by a key number indicating the key depressed, the envelope data which is defined by touch data indicating the strength (speed) of the key depression and the waveform address which is defined by a timber number (which is specified in the play buffer 120 for the tone-ON channel assigned for the keyboard 14) is sent to the tone generator 15. Consequently, based on the tone data, the assigned oscillator in the tone generator 15 produces a tone signal, which will be sent via the amplifier 18 to the loudspeaker 17 to be generated as a musical tone.

In the keyboard event process, when the occurrence of an OFF event is determined, on the other hand, the oscillator in the tone generator 15 which is assigned to the OFF-even key is detected and the release envelope data is sent to this oscillator to set the tone off.

When this keyboard event process is terminated or it is determined in the aforementioned step S13 that no keyboard event has occurred, an demonstration performance process is then executed (step S15). The details of this demonstration performance process will be given later.

Next, an other processing is executed (step S16). This "an other processing" includes a process for transmission and reception of MIDI data. Thereafter, the flow returns to step S11 to repeat the above-described sequence of processes. When an event originated from the panel operation or the keyboard operation occurs during the repetitive execution of steps S11 to S16, the process associated with that event is carried out. In this manner, the individual functions of the electronic musical instrument are accomplished.

The details of the panel event process will now be given with reference to the flowchart in FIG. 3.

In the panel event process, it is checked first whether the event-detected switch is the demonstration performance switch 13B (step S20). This is accomplished by checking if the bit in the panel event map, which corresponds to the demonstration performance switch 13B, is set on.

If it is determined that the event-detected switch is the demonstration performance switch 13B, it is then checked if it is an ON event (step S21). This is accomplished by checking if the bit in the new panel data, which corresponds to the demonstration performance switch 13B, is set on. When the bit in the new panel data, which corresponds to the demonstration performance switch 13B, is set on, it means an ON event, while that bit being off means an OFF event.

When it is determined in step S21 that the even is an ON event, a demonstration performance flag is set to "1" (step S22). The demonstration performance flag is defined in the RAM 12 and is used to memorize whether or not a demonstration performance is process. This demonstration performance flag is referred to in an automatic performance processing routine which will be described later.

At the same time the demonstration performance flag is set, a time counter (not shown) starts counting up. This time counter is used in the automatic performance processing (to be described later) to check if the timing is for tone generation process or tone OFF process based on the occurrence or absence of an automatic performance event or the automatic performance data.

Then, the contents of the play buffer 120 are saved in a predetermined saving area (second memory means) provided in the RAM 12 (step S23). Next, the part data for the demonstration performance is set in the play buffer 120 (step S24). More specifically, the part data included in the demonstration performance data corresponding to the demonstration music piece selected through the control panel 13 is read out from the ROM 11 and is set in the play buffer 120. The function of the first processing means is accomplished by the steps S23 and S24.

The selection of a demonstration music piece is performed in the "other switch processing" in step S27 which will be discussed later, and the number of the selected demonstration music piece (or music name) is stored in a demonstration music number buffer in the RAM 12. The part data for the demonstration performance is selected in accordance with the number of the demonstration music piece stored in this demonstration music number buffer.

If it is determined in step S21 that the event is not an ON event but is an OFF event, it is understood that the demonstration performance switch 13B has been operated during the demonstration performance and a process for terminating the demonstration performance will be carried out next. First, the demonstration performance flag is cleared to "0" (step S25), and the part data, previously saved in the predetermined saving area in the RAM 12, is restored into the play buffer 120 (step S26). The function of the second processing means is accomplished by this step S26. As a result, the contents of the play buffer 120 are restored to what had been before the demonstration performance started. The processes is steps S25 and S26 may be omitted if the electronic musical instrument has not the function to terminate the demonstration performance in progress.

Next, the other switch processing will be carried out (step S27). The "other switch processing" includes a process for the aforementioned selection of a demonstration music piece, a process for an event on the timbre select switch, a process for an event on the volume switch, and a process for an event on the effect designate switch.

The process for selecting a demonstration music piece is a process to display a desired numeral (or music name) on the display unit 13A by the operation of the value setting switches 13C, and to store the same data as the displayed numeral (or music name) into the demonstration music number buffer in the RAM 12. The demonstration music number (or music name) stored in the demonstration music number buffer in the RAM 12, is referred to in step S24 as mentioned earlier. When the above process is complete, the flow returns to the main routine from the panel event processing routine.

The details of the automatic performance process will now be given with reference to the flowchart in FIG. 4. The demonstration performance is accomplished as a special case of the automatic performance process (simultaneous automatic performance of all parts). As the processes for the individual parts are the same, however, an operation for only one part will be explained below.

In the automatic performance process, it is checked first if the demonstration performance flag is "1" (step S30). When the demonstration performance flag is determined to be "0", that is, the mode is the normal performance mode, the CPU 10 leaves this automatic performance processing routine without executing further processes.

When the demonstration performance flag is determined to be "1", that is, the mode is the demonstration performance mode, it is checked if there is an automatic performance event (step S31). The CPU 10 accomplishes this check by reading out one piece of automatic performance data from the ROM 11 and then comparing the step time included in this automatic performance data with the time value counted by the time counter (not shown).

When it is determined that there has occurred no automatic performance event or the comparison has not resulted in a match, the flow returns to the main routine from this automatic performance processing routine without execution of the subsequent processes. When it is determined that an automatic performance event has occurred or the comparison has resulted in a match, it is then checked if the automatic performance data is note-ON data (step S32).

When the data is determined to be note-ON data, a tone generating process is executed (step S33). In this tone generating process, an oscillator to be used is determined by the assigner, and data indicating the oscillator and tone data including the frequency data, the envelope data and waveform address are sent to the tone generator 15, as done in the case of the tone generating process in the above-described keyboard event process. In this case, the block in the play buffer 120, which corresponds to the tone-ON channel assigned to the part to which the note-ON data belongs, is referred to and tone data is produced based on the timbre, volume, pan-pot and other data stored in that block.

Consequently, the oscillator assigned for tone generation reads out the waveform data from the wave memory and adds an envelope to the waveform data to generate a tone signal. The tone signal generated by the tone generator 15 is supplied to the amplifier 16 to be amplified by a given amplification factor. The amplified tone signal is supplied to the loudspeaker 17 to be generated as a musical tone. When this tone generating process is complete, the flow returns to the main routine from this automatic performance processing routine.

When it is determined in step S32 that the automatic performance data is not note-ON data, it is then checked if the data is note-OFF data (step S34). If the data is determined to be note-OFF data, the tone-OFF process is executed (step S35).

In this tone OFF process, as in the case of the key OFF event in the above-described keyboard event process, the oscillator in the tone generator 15 which is assigned to note OFF is detected, and the release envelope data is sent to this oscillator to set the tone off. Thereafter, the flow returns to the main routine from this automatic performance processing routine.

When it is determined in step S34 that the automatic performance data is not note-OFF data, it is then checked if the demonstration music piece is finished (step S36). This is accomplished by checking if one piece of automatic performance data read out from the ROM 11 has a special code indicating the end of music.

When the end of the demonstration music piece is detected, the part data previously saved in the predetermined saving area in the RAM 12 is restored in the play buffer 120 (step S37). The function of the second processing means is accomplished by this step S37. Accordingly, at the same time as the demonstration performance is complete, the contents of the play buffer 120 are restored to what had been before the demonstration performance started. Then, the demonstration performance flag is cleared to "0" (step S38). Even if the automatic performance processing routine is called thereafter, therefore, it is determined in step S30 that the demonstration performance flag is not "1", CPU 10 leaves this automatic performance processing routine without executing further processes. In other words, the performance of the demonstration music piece is terminated. Thereafter, the flow returns to the main routine from the automatic performance processing routine.

When it is determined in step S36 that the demonstration music piece is not finished, the other processing is executed (step S39). This "other processing" includes other same processes as those of the above-described tone generating process and tone OFF process, such as timbre change and volume change, which are specified by the automatic performance data. Since those processes are not directly concerned with the present invention, their description will not be given.

According to this embodiment, as described above, the part data and the automatic performance data corresponding to the demonstration music pieces have been stored in the ROM 11, and when an instruction is given to start the automatic performance of a demonstration music piece, the part data currently in use, stored in the play buffer 120 then, is saved in the saving area in the RAM 12, the part data corresponding to the demonstration music piece is read out from the ROM 11 and is set in the play buffer 120, and an automatic performance of the demonstration music piece is executed based on the part data, set in the play buffer 120, and the automatic performance data stored in association with this demonstration music piece in the ROM 11. When the end of the demonstration music piece is detected, or when the demonstration performance switch 13B is depressed to stop playing the demonstration music piece during the demonstration performance, for example, the part data, saved earlier in the predetermined saving area in the RAM 12, is restored in the play buffer 120 to set the contents of the play buffer 120 back to what had been before the demonstration performance started.

Since the part data and the automatic performance data corresponding to each demonstration music piece are previously stored as a pair in the ROM 11, and when an instruction is given to start a demonstration performance, the demonstration performance is carried out based on the part data and the automatic performance data associated with that demonstration music piece, the part data will always match with the automatic performance data. The present invention therefore comes free of the restriction of the prior art that a demonstration music piece matching with the initial values of the part data should be selected, thus allowing every piece of music to be used as a demonstration music piece.

In starting a demonstration performance, after the part data, presently stored in the play buffer 120, is saved in the predetermined saving area in the RAM 12, new part data corresponding to the demonstration music piece is set in the play buffer 120, and then the demonstration performance is started. Regardless of what has been set in the play buffer 120 before the demonstration performance starts, therefore, the proper demonstration performance will be started. When the demonstration performance is stopped, the part data, saved previously in the saving area in the RAM 12, is restored in the play buffer 120, so that when the demonstration performance is stopped, it is possible to return the state in which the electronic musical instrument had been before starting the demonstration performance. The electronic musical instrument of the present invention therefore requires no manual operation to rewrite data in the play buffer 120 in order to start a demonstration performance or to return the state in which the instrument had been before the demonstration performance started, and is thus excellent in operability.

The foregoing description of this embodiment has been given with reference to a case where in executing a demonstration performance, the contents of the play buffer 120 are saved before the demonstration performance and restored after the demonstration performance so that the electronic musical instrument can return to the state in which it had been before the demonstration performance started. This function is not limited to the case of a demonstration performance. This embodiment may be modified in such a way that the contents of the play buffer 120 are saved and restored respectively, before the normal automatic performance such as automatic accompaniment starts and after it is complete.

In short, the present invention can provide an electronic musical instrument with an excellent operability, which can use various pieces of music as demonstration music, can start a proper demonstration performance regardless of its state, and can return the state in which the instrument had been before the demonstration performance, when the demonstration performance is completed.

What is claimed is:

1. An electronic musical instrument for generating musical tones based on part data and automatic performance data to thereby execute an automatic performance, comprising:

first memory means in which part data and automatic performance data corresponding to demonstration music pieces have been stored;

a play buffer for storing the part data currently in use;

second memory means for temporarily saving the contents of said play buffer;

start instructing means for instructing a start of a performance of a demonstration music piece;

first processing means for saving said currently used part data, stored in said play buffer, into said second memory means, and for reading out the part data corresponding to a demonstration music piece from said first memory means and for setting said readout part data in said play buffer, when instructed by said start instructing means;

automatic performance means for executing an automatic performance based on said part data, set in said play buffer by said first processing means, and said automatic performance data stored in said first memory means; and second processing means for restoring said part data, saved in said second memory means by said first processing means, into said play buffer when said automatic performance means stops executing an automatic performance.

2. The electronic musical instrument according to claim 1, wherein said second processing means detects an end of a demonstration music piece, and restores said part data, saved in said second memory means by said first processing means, into said play buffer in accordance with that detection.

3. The electronic musical instrument according to claim 1, further comprising stop instructing means for giving an instruction to stop playing a demonstration music piece in automatic performance, and wherein said second processing means restores said part data, saved in said second memory means by said first processing means, into said play buffer in accordance with said instruction from said stop instructing means.

4. The electronic musical instrument according to claim 3, wherein said stop instructing means is constituted of the same switch as said start instructing means.

5. The electronic musical instrument according to claim 1, wherein said first processing means is a central processing unit.

6. The electronic musical instrument according to claim 1, wherein said second processing means is a central processing unit.

7. The electronic musical instrument according to claim 1, wherein said automatic performance means comprises a central processing unit and a tone generator.

8. The electronic musical instrument according to claim 1, wherein said play buffer is a random access memory.

* * * * *

UNITED STATES PATENT AND TRADEMARK OFFICE

CERTIFICATE OF CORRECTION

PATENT NO. : 5,430,242
DATED : July 4, 1995
INVENTOR(S) : Shigehiro MORITA

It is certified that error appears in the above-indentified patent and that said Letters Patent is hereby corrected as shown below:

On the title page, insert item

[30] Foreign Application Priority Data
March 8, 1993 [JP] Japan . . . . . .5-70711

Signed and Sealed this
Twelfth Day of December, 1995

*Attest:*

*Attesting Officer*

Bruce Lehman

BRUCE LEHMAN
*Commissioner of Patents and Trademarks*